US012130100B2

(12) United States Patent
Wei et al.

(10) Patent No.: US 12,130,100 B2
(45) Date of Patent: Oct. 29, 2024

(54) HEAT EXCHANGER

(71) Applicant: ZHEJIANG DUNAN ARTIFICIAL ENVIRONMENT CO., LTD., Zhejiang (CN)

(72) Inventors: Wenjian Wei, Zhejiang (CN); Wenyong Ma, Zhejiang (CN); Qing Xiao, Zhejiang (CN); Guanjun Wang, Zhejiang (CN); Yi Fan, Zhejiang (CN)

(73) Assignee: ZHEJIANG DUNAN ARTIFICIAL ENVIRONMENT CO., LTD., Zhejiang (CN)

( * ) Notice: Subject to any disclaimer, the term of this patent is extended or adjusted under 35 U.S.C. 154(b) by 52 days.

(21) Appl. No.: 17/763,671

(22) PCT Filed: Sep. 27, 2020

(86) PCT No.: PCT/CN2020/118179
§ 371 (c)(1),
(2) Date: Mar. 25, 2022

(87) PCT Pub. No.: WO2021/057983
PCT Pub. Date: Apr. 1, 2021

(65) Prior Publication Data

US 2022/0333877 A1 Oct. 20, 2022

(30) Foreign Application Priority Data

Sep. 27, 2019 (CN) ..... 201910927921.5

(51) Int. Cl.
*F28F 9/18* (2006.01)
*F28D 1/03* (2006.01)
*F28F 9/02* (2006.01)

(52) U.S. Cl.
CPC ..... *F28F 9/18* (2013.01); *F28D 1/0308* (2013.01); *F28F 9/0219* (2013.01)

(58) Field of Classification Search
CPC ..... F28F 3/08; F28F 9/0221; F28F 9/0224; F28F 9/182; F28F 9/0278; F28F 9/028; F28F 9/0282; F28F 9/0251
See application file for complete search history.

(56) References Cited

U.S. PATENT DOCUMENTS 3,670,812 A * 6/1972 Bemrose ..... F28D 1/0325 165/DIG. 488
5,107,926 A * 4/1992 Calleson ..... F28F 9/0214 165/173

(Continued)

FOREIGN PATENT DOCUMENTS

CN 105531553 A 4/2016
CN 107614999 A 1/2018

(Continued)

OTHER PUBLICATIONS

DE3047411A1 English Machine Translation (Year: 1982).*
EP1923653A1 English Machine Translation (Year: 2008).*
DE3813339A1 English Machine Translation (Year: 1989).*

*Primary Examiner* — Jenna M Maroney
(74) *Attorney, Agent, or Firm* — Samson G. Yu

(57) ABSTRACT

A heat exchanger, including: a plurality of flat pipes, wherein, the plurality of flat pipes are arranged at intervals; first sealing cushion blocks, arranged between two adjacent flat pipes, wherein the first sealing cushion blocks are located on end portions of the flat pipes, so as to seal gaps between two adjacent flat pipes by means of the first sealing cushion blocks; and a flow collecting shell, provided with a first opening portion, wherein at least part of the first sealing cushion blocks and the end portions of the flat pipes are all plugged into the first opening portion, so that the flow collecting shell, the flat pipes and the first sealing cushion blocks form a flow collecting channel in an encircling manner.

12 Claims, 6 Drawing Sheets

(56) References Cited

U.S. PATENT DOCUMENTS

| | | | | | |
|---|---|---|---|---|---|
| 5,193,613 | A * | 3/1993 | Wallis | F28F 9/0243 | 165/173 |
| 6,032,728 | A * | 3/2000 | Ross | F28D 1/05366 | 165/173 |
| 7,231,960 | B2 * | 6/2007 | Sakai | H01L 23/473 | 165/83 |
| 11,802,733 | B2 * | 10/2023 | Wei | F28D 1/03 | |
| 2008/0230213 | A1 * | 9/2008 | Roll | B21D 53/08 | 165/173 |
| 2019/0093964 | A1 | 3/2019 | Kikuchi et al. | | |

FOREIGN PATENT DOCUMENTS

| | | | | |
|---|---|---|---|---|
| CN | 210922275 | U | 7/2020 | |
| DE | 3047411 | A1 * | 7/1982 | |
| DE | 3813339 | A1 * | 11/1989 | |
| DE | 10103584 | A1 | 8/2002 | |
| EP | 1923653 | A1 * | 5/2008 | F28D 1/05366 |

* cited by examiner

HEAT EXCHANGER

CROSS-REFERENCE TO RELATED APPLICATION

The present disclosure is a national stage application of International Patent Application No. PCT/CN2020/118179, which is filed on Sep. 27, 2020. The present disclosure claims the priority of Chinese Application No. 201910927921.5, filed in the Chinese Patent Office on Sep. 27, 2019, and entitled "Heat Exchanger", the entire contents of which are herein incorporated by reference.

TECHNICAL FIELD

The present disclosure relates to the technical field of heat exchangers, and in particular to a heat exchanger.

BACKGROUND

At present, a heat exchanger in an art known to inventors generally includes a circular flow collecting pipe and a plurality of flat pipes. The circular flow collecting pipe is provided with a plurality of plug-in holes, and the plurality of flat pipes are arranged with the plurality of plug-in holes in a one-to-one correspondence manner. Each flat pipe is plugged into a corresponding plug-in hole, and then is welded.

During a welding process, the flat pipe is subjected to the rigid constraint of the plug-in hole of the flow collecting pipe, therefore even if the flat pipe is subjected to a pre-tightening force of a fixture, the flat pipe will hardly move in a height direction, especially the flat pipe that is close to an end portion location of the flow collecting pipe. During the welding, since a composite layer on a plate surface of the flat pipe will melt, some welding points near the plug-in holes of the flow collecting pipe will be difficult to be welded, which will easily form false welding, thus affecting the pressure resistance of a product.

SUMMARY

Some embodiments of the present disclosure provide a heat exchanger, so as to solve a technical problem of relatively weak connection strength between a flow collecting pipe and a flat pipe in the art known to inventors.

Some embodiments of the present disclosure provide a heat exchanger, including: a plurality of flat pipes, wherein the plurality of flat pipes are arranged at intervals; first sealing cushion blocks, arranged between two adjacent flat pipes, wherein the first sealing cushion blocks are located on end portions of the flat pipes, so as to seal gaps between two adjacent flat pipes by the first sealing cushion blocks; and a flow collecting shell, provided with a first opening portion, wherein at least part of the first sealing cushion blocks and the end portions of the flat pipes are all inserted into the first opening portion, so that the flow collecting shell, the flat pipes and the first sealing cushion blocks form a flow collecting channel in an encircling manner.

In some embodiments, the flow collecting shell includes a main body portion and a plug-in portion, the plug-in portion is arranged on the main body portion, wherein the plug-in portion is arranged at an end portion of the main body portion, the plug-in portion is provided with a first opening portion, and at least part of the first sealing cushion block and an end portion of the each flat pipe are plugged into the plug-in portion.

In some embodiments, the plug-in portion includes a first plug board and a second plug board, the first plug board and the second plug board are oppositely arranged on both ends of the main body portion, and the first plug board and the second plug board are arranged at intervals to form the first opening portion, so that at least part of the first sealing cushion block and the end portion of the each flat pipe are all plugged between the first plug board and the second plug board.

In some embodiments, the first sealing cushion block includes a first main body block and a first plug-in block, the first plug-in block is arranged on the first main body block, the first main body block is arranged at the end portion of the flat pipe, and the first plug-in block is plugged into the first opening portion.

In some embodiments, the first plug-in block has a first side surface, a second side surface and an arc-shaped concave surface, the first side surface, the arc-shaped concave surface and the second side surface are connected in sequence, the arc-shaped concave surface is located on a side of the first plug-in block away from the first main body block, the first side surface is plugged at the first plug board, and the second side surface is plugged at the second plug board.

In some embodiments, each first sealing cushion block is provided with a first positioning structure, a second positioning structure cooperating with the first positioning structure is arranged on a corresponding flat pipe in the two adjacent flat pipes, and the first positioning structure opposites to the second positioning structure, so as to position the first sealing cushion block by the first positioning structure and the second positioning structure.

In some embodiments, the first positioning structure is a first positioning protrusion, the second positioning structure is a first positioning groove, the first positioning protrusion is arranged opposite to the first positioning groove, and the first positioning protrusion is arranged in the first positioning groove, so as to position the first sealing cushion block.

In some embodiments, each first sealing cushion block has a first binding surface and a second binding surface, which are arranged opposite to each other, an end portion of each flat pipe has a first surface and a second surface, which are arranged opposite to each other, the first binding surface is cooperated with the first surface of the end portion of the each flat pipe, and the second binding surface is cooperated with the second surface of the end portion of the each flat pipe, so that the first binding surface is configured to fit the first surface, and the second binding surface is configured to fit the second surface.

In some embodiments, the flow collecting shell is provided with a second opening portion and a third opening portion opposite to the second opening portion, the second opening portion is located on an end of the flow collecting shell, the third opening portion is located on the other end of the flow collecting shell, and the first opening portion, the second opening portion and the third opening portion all communicate with each other; and the heat exchanger further includes sealing covers, and the sealing covers are arranged at both the second opening portion and the third opening portion, so as to seal the second opening portion and the third opening portion by the sealing covers.

In some embodiments, the heat exchanger further includes a second sealing cushion block, wherein the second sealing cushion block is arranged between a sealing cover in the sealing covers and a corresponding flat pipe, and a third positioning structure is arranged on a side of the second sealing cushion block close to the sealing cover, so as to position the sealing cover by the third positioning structure.

In some embodiments, the second sealing cushion block includes a second main body block and a second plug-in block, wherein the second plug-in block is arranged on the second main body block, the second main body block protrudes from the second plug-in block, so as to form a positioning step in an encircling manner, and the positioning step forms the third positioning structure, so as to position the sealing cover by means of the positioning step.

In some embodiments, a fourth positioning structure is further arranged on the flat pipe, a fifth positioning structure cooperated with the fourth positioning structure is arranged on the second sealing cushion block, and the fourth positioning structure is arranged opposite to the fifth positioning structure, so as to position the second sealing cushion block by the fourth positioning structure and the fifth positioning structure.

In some embodiments, the fourth positioning structure is a second positioning protrusion, the fifth positioning structure is a second positioning groove, the second positioning protrusion is opposite to the second positioning groove, and the second positioning protrusion is arranged in the second positioning groove, so as to position the second sealing cushion block.

In some embodiments, an end portion of each flat pipe is provided with an arc-shaped port, and the arc-shaped port is plugged into the first opening portion, so that the flow collecting channel communicates with a fluid channel in the flat pipe.

In some embodiments, the flow collecting shell, the each flat pipe and the first sealing cushion block are welded to form the flow collecting channel in the encircling manner.

According to the technical solutions of the present disclosure, by plugging at least part of the first sealing cushion blocks and the end portions of the flat pipes into the first opening portion, the flow collecting shell, the plurality of flat pipes and the plurality of first sealing cushion blocks can form the flow collecting channel in the encircling manner. In this way, during welding, each flat pipe is not constrained in a height direction. Specifically, when the heat exchanger is welded in a furnace, the flat pipe is freely declined under a pre-tightening action of a fixture, after a composite layer on the surface of the flat pipe is melted, two pipe plates of the flat pipe can always be kept pressed and abutted, so as to ensure that all welding points on the pipe plates can be welded together, such that a connection strength between the flow collecting shell and the flat pipe is improved, and the pressure resistance of a product is ensured. Therefore, by the technical solutions provided by some embodiments of the present disclosure, the technical problem of relatively weak connection strength between the flow collecting pipe and the flat pipe in the art known to inventors is solved.

BRIEF DESCRIPTION OF THE DRAWINGS

The drawings constituting a part of the present disclosure are used for providing a further understanding of the present disclosure, and exemplary embodiments of the present disclosure and descriptions thereof are used for explaining the present disclosure, but do not constitute improper limitations of the present disclosure. In the drawings.

Figure 1:
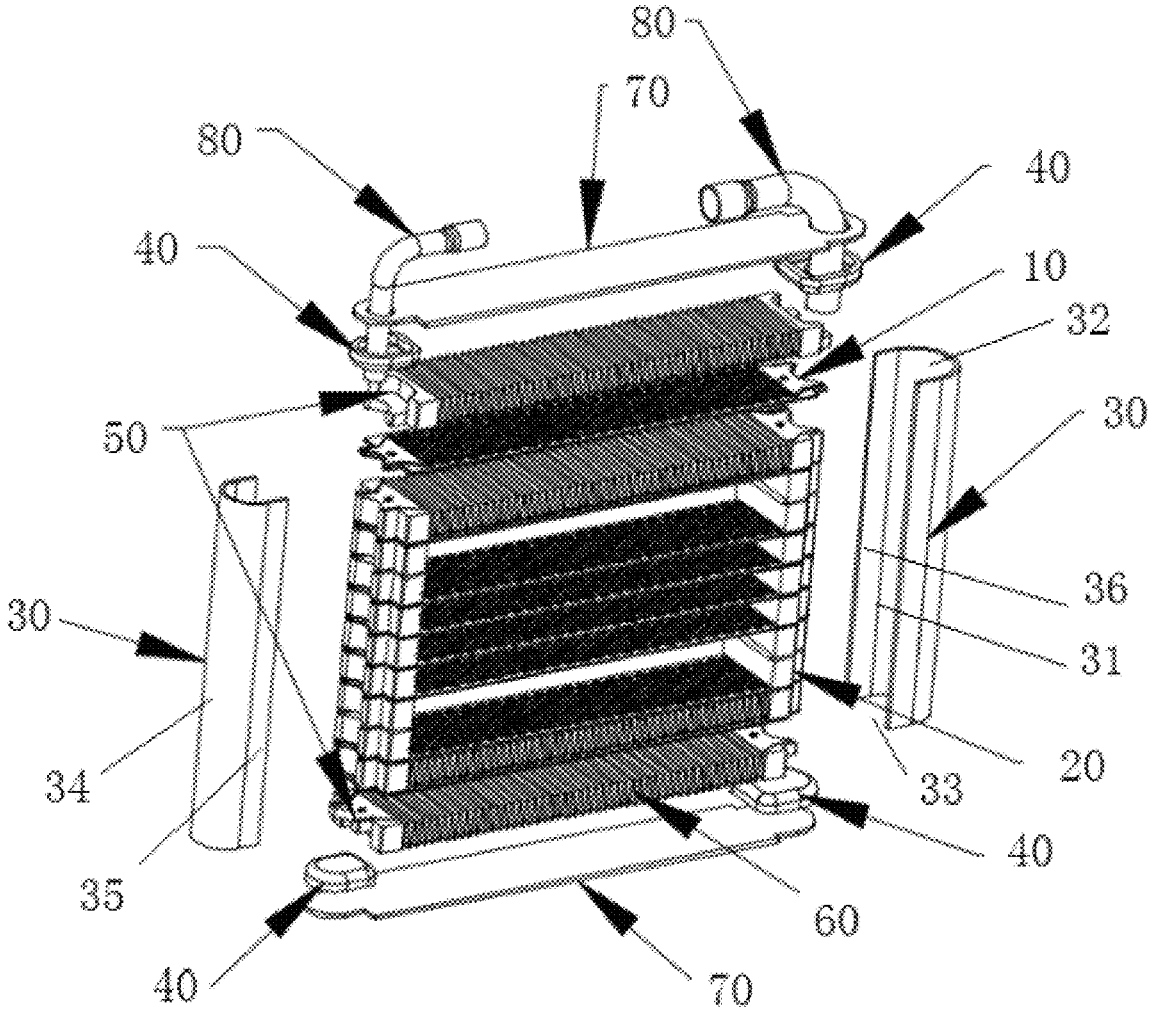
FIG. 1 shows an exploded view of a heat exchanger provided according to Embodiment 1 of the present disclosure.
Figure 2:
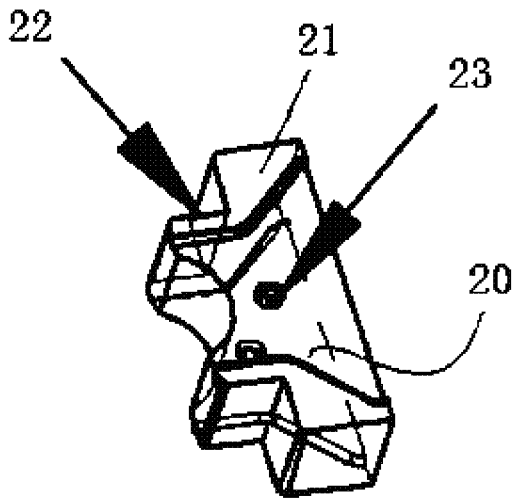
FIG. 2 shows a schematic structural diagram of a first sealing cushion block provided according to Embodiment 1 of the present disclosure.
Figure 3:
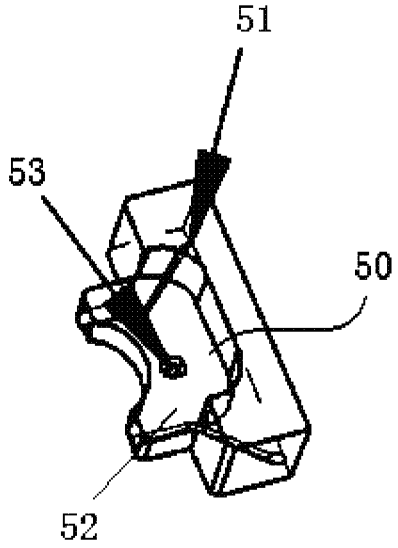
FIG. 3 shows a schematic structural diagram of a second sealing cushion block provided according to Embodiment 1 of the present disclosure.
Figure 4:
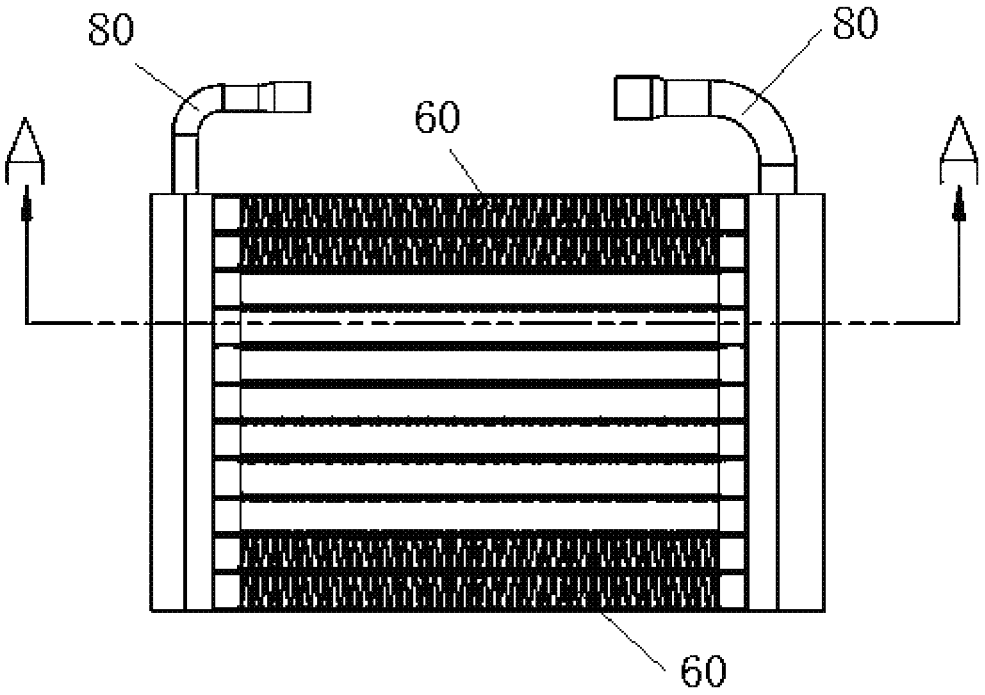
FIG. 4 shows a front view of the heat exchanger provided according to Embodiment 1 of the present disclosure.
Figure 5:
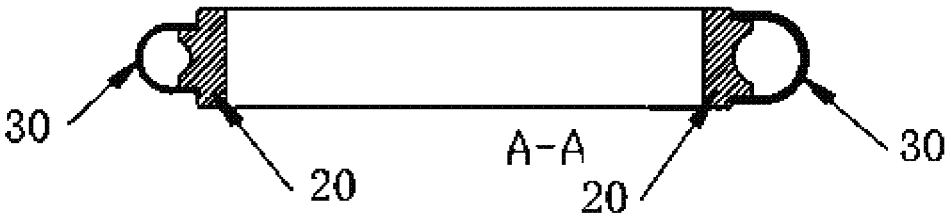
FIG. 5 shows an A-A direction view in FIG. 4.
Figure 6:
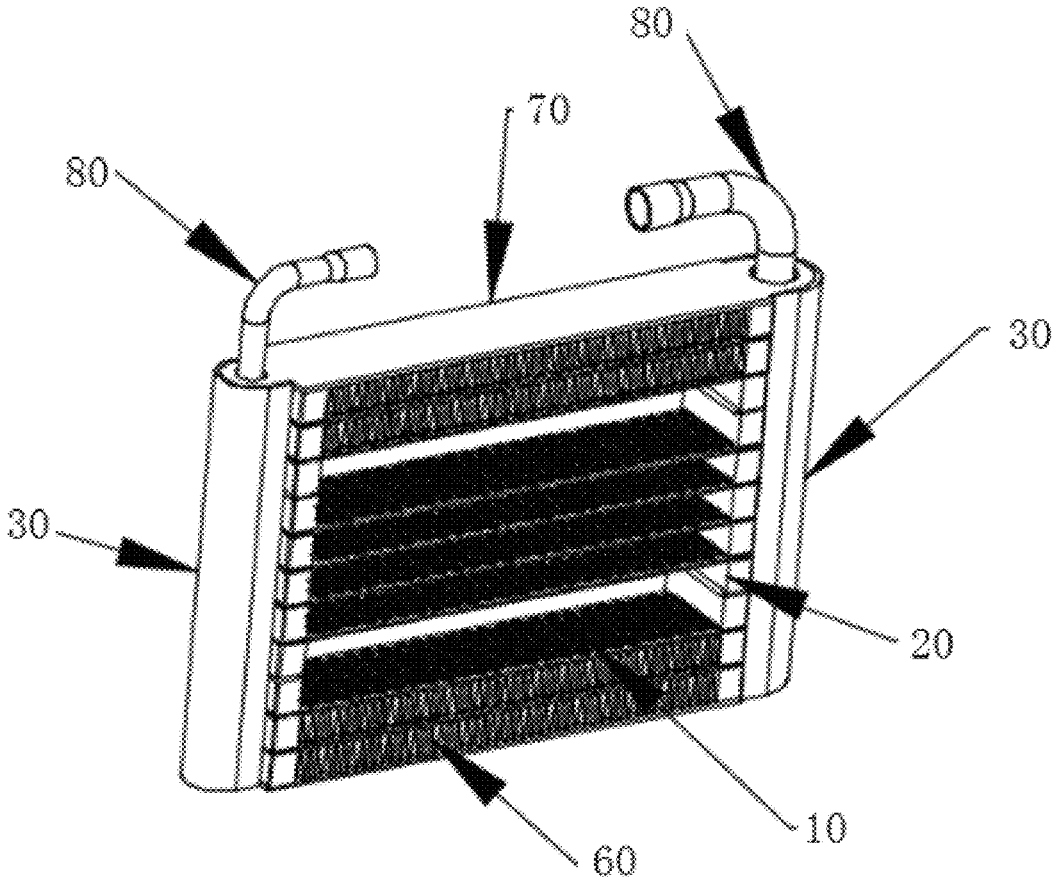
FIG. 6 shows a side view of the heat exchanger provided according to Embodiment 1 of the present disclosure.
Figure 7:
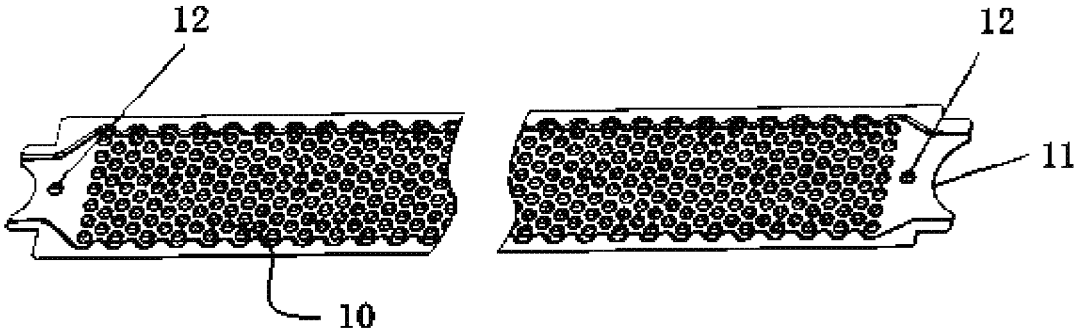
FIG. 7 shows a schematic structural diagram of a flat pipe provided according to Embodiment 1 of the present disclosure.
Figure 8:
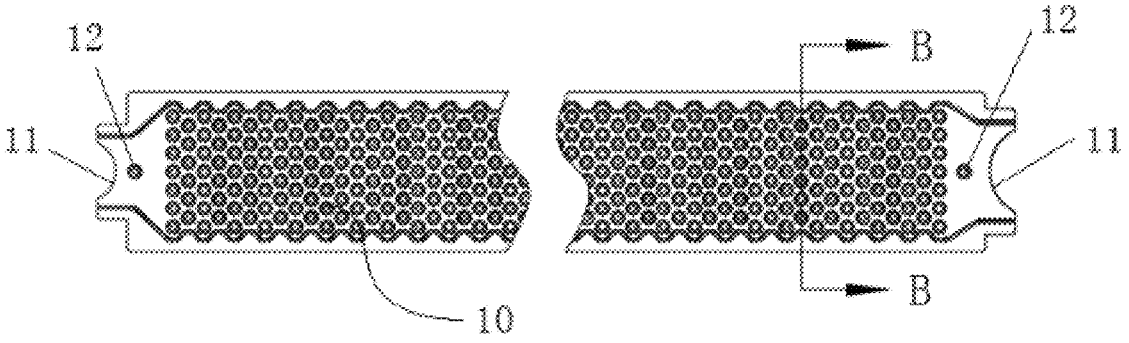
FIG. 8 shows a front view of the flat pipe provided according to Embodiment 1 of the present disclosure.
Figure 9:
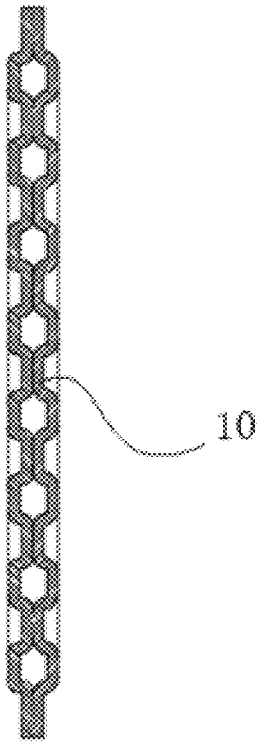
FIG. 9 shows a B-B direction view in FIG. 8.

The above drawings include the following reference signs:

10. flat pipe; 11. arc-shaped port; 12. second positioning structure; 20. first sealing cushion block; 21. first main body block; 22. first plug-in block; 23. first positioning structure; 30. flow collecting shell; 31. first opening portion; 32. second opening portion; 33. third opening portion; 34. main body portion; 35. first plug board; 36. second plug board; 40. sealing cover; 50. second sealing cushion block; 51. second main body block; 52. second plug-in block; 53. fifth positioning structure; 60. heat exchange fin; 70. side plate; 80. connecting pipe.

DETAILED DESCRIPTION OF THE EMBODIMENTS

It should be noted that, if there is no conflict, embodiments in the present disclosure and features in the embodiments can be combined with each other. Hereinafter, the present disclosure will be described in detail with reference to the drawings and in conjunction with the embodiments.

As shown in FIG. 1 to FIG. 9, Embodiment 1 of the present disclosure provides a heat exchanger. The heat exchanger includes: flat pipes 10, first sealing cushion blocks 20 and a flow collecting shell 30, wherein a plurality of flat pipes 10 are provided, and the plurality of flat pipes 10 are arranged at intervals. A plurality of first sealing cushion blocks 20 are provided, the first sealing cushion block 20 is arranged between two adjacent flat pipes 10, and the first sealing cushion blocks 20 are located on end portions of the flat pipes 10, so as to seal gaps between two adjacent flat pipes 10. The flow collecting shell 30 is provided with a first opening portion 31, and at least part of the first sealing cushion blocks 20 and the end portions of the flat pipes 10 are all plugged into the first opening portion 31, so that the flow collecting shell 30, the flat pipes 10 and the first sealing cushion blocks 20 form a flow collecting channel in an encircling manner.

According to the heat exchanger provided by the present embodiment, by plugging at least part of the first sealing cushion blocks 20 and the end portions of the flat pipes 10 into the first opening portion 31, the flow collecting shell 30, the plurality of flat pipes 10 and the plurality of first sealing cushion blocks 20 form the flow collecting channel in the encircling manner. In this way, when the heat exchanger is welded in a furnace, since the flat pipe 10 is not constrained by the first opening portion 31 in a height direction, the flat pipe 10 is freely declined under a pre-tightening action of a fixture. Specifically, the flat pipe 10 is declined along an extension direction of an opening of the first opening portion 31 (the extension direction of the first opening portion 31 is the same as a flow direction of liquid in the flow collecting shell 30). After a composite layer on the surface of the flat pipe 10 is melted, two pipe plates of the flat pipe 10 can always be kept pressed and fit, so as to ensure that all welding points on the pipe plates can be welded together, such that the connection strength between the flow collecting shell 30 and the flat pipe 10 is improved, and a pressure resistance of the heat exchanger is ensured. Therefore, by the heat exchanger provided by the embodiments of the present disclosure, the technical problem of relatively weak connection strength between a flow collecting pipe and the flat pipe 10 in an art known to inventors is solved.

In the present embodiment, the flow collecting shell 30 includes a main body portion 34 and a plug-in portion, the plug-in portion is arranged on the main body portion 34, the plug-in portion is arranged at an end portion of the main body portion 34, the plug-in portion is provided with a first opening portion 31, and at least part of the first sealing cushion block 20 and the end portion of the flat pipe 10 are plugged into the plug-in portion. By using such settings, at least part of the first sealing cushion block 20 and the end portion of the flat pipe 10 are conveniently plugged at the first opening portion 31, a stability of connection is improved, and a worker can conveniently perform pre-installation before welding, therefore the convenience of operation is improved. In some embodiments, the main body portion 34 is an arc-shaped shell, so as to form the flow collecting channel in the encircling manner. In the present embodiment, the main body portion 34 and the plug-in portion can be an integrally formed structure. In some embodiments, the flow collecting shell 30 is a C-shaped opening shell structure.

In the present embodiment, the plug-in portion includes a first plug board 35 and a second plug board 36, and the first plug board 35 and the second plug board 36 are oppositely arranged on both ends of the main body portion 34. The first plug board 35 and the second plug board 36 are arranged at intervals to form the first opening portion 31, so that at least part of the first sealing cushion block 20 and the end portion of the flat pipe 10 are all plugged between the first plug board 35 and the second plug board 36. By using such settings, the connection stability among the first sealing cushion block 20, the flat pipe 10 and the flow collecting shell 30 can be further improved, thereby preventing the first sealing cushion block 20 from falling off the flow collecting shell 30 and preventing the flat pipe 10 from falling off the flow collecting shell 30 before welding. In some embodiments, the first plug board 35 and the second plug board 36 can also be arranged in parallel. Or, along an extension direction from the main body portion 34 to the plug-in portion, a distance between the first plug board 35 and the second plug board 36 gradually decreases, so as to better improve the stability of plug-in connection and to better improve the connection stability among the first sealing cushion block 20, the flat pipe 10 and the flow collecting shell 30.

In the present embodiment, the first sealing cushion block 20 includes a first main body block 21 and a first plug-in block 22, the first plug-in block 22 is arranged on the first main body block 21, the first main body block 21 is arranged at the end portion of the flat pipe 10, and the first plug-in block 22 is plugged into the first opening portion 31. By using such settings, the gap between two adjacent flat pipes 10 can be sealed by the first main body block 21, and the first plug-in block 22 can be conveniently plugged into the first opening portion 31, so as to form the flow collecting channel in the encircling manner. In some embodiments, the first main body block 21 and the first plug-in block 22 can be an integrally formed structure. In some embodiments, the first sealing cushion block 20 is a T-shaped block, the T-shaped block is plugged into an opening side of the C-shaped flow collecting shell 30, an inner side wall of the end portion of the C-shaped flow collecting shell 30 is clamped with an outer side wall of the T-shaped block, and the first sealing cushion block 20, the flow collecting shell 30 and the flat pipe 10 are integrated after brazing. A plurality of first sealing cushion blocks 20 that are stacked together can be arranged between two adjacent flat pipes 10 according to actual situations.

In some embodiments, the first plug-in block 22 has a first side surface, a second side surface and an arc-shaped concave surface, the first side surface, the arc-shaped concave surface and the second side surface are connected in sequence, the arc-shaped concave surface is located on a side of the first plug-in block 22 away from the first main body block 21, the first side surface is plugged at the first plug board 35, and the second side surface is plugged at the second plug board 36. By using such settings, it is possible to facilitate a better plug-in connection and improve the stability of the connection. At the same time, by adding the arc-shaped concave surface between the first side surface and the second side surface, a blocking effect of the first plug-in block 22 on the flow of fluid in the flow collecting pipe is reduced, such that a flow cross-sectional area in the flow collecting pipe is increased, and a flow speed of the fluid is improved.

In some embodiments, a first positioning structure 23 is arranged on the first sealing cushion block 20, a second positioning structure 12 cooperating with the first positioning structure 23 is arranged on the flat pipe 10, and the first positioning structure 23 is opposite to the second positioning structure 12, so as to position the first sealing cushion block 20 by the first positioning structure 23 and the second positioning structure 12. By using such settings, it is possible to avoid malposition of the first sealing cushion block 20 between two adjacent flat pipes 10 resulting from shake during an assembly process. Under the cooperation of the first positioning structure 23 and the second positioning structure 12, the first sealing cushion block 20 is stably positioned, thereby ensuring the setting stability of the first sealing cushion block 20, and it is convenient to ensure that the first sealing cushion block 20 or the flat pipe 10 will not move during the welding process.

In some embodiments, the first positioning structure 23 is a first positioning protrusion, the second positioning structure 12 is a first positioning groove, the first positioning protrusion is arranged opposite to the first positioning groove, and the first positioning protrusion is arranged in the first positioning groove, so as to position the first sealing cushion block 20. The first positioning protrusion and the first positioning groove are simple in structure and are convenient to manufacture. Meanwhile, by the cooperation of the first positioning protrusion and the first positioning groove, the stability of positioning is improved, and the shake of the first sealing cushion block 20 relative to the flat pipe 10 is better avoided.

In some embodiments, the first sealing cushion block 20 has a first binding surface and a second binding surface, which are arranged opposite to each other, the end portion of the flat pipe 10 has a first surface and a second surface, which are arranged opposite to each other, the first binding surface is cooperated with the first surface of the end portion of the flat pipe 10, and the second binding surface is cooperated with the second surface of the end portion of the flat pipe 10, so that the first binding surface is configured to bind the first surface, and the second binding surface is configured to bind the second surface. Specifically, along the flow direction of the fluid in the flow collecting shell 30, the first sealing cushion block 20 has a first surface and a second surface, which are arranged opposite to each other. By using such a binding setting, the gap between two adjacent flat pipes 10 is better sealed by the first sealing cushion block 20, so as to prevent the fluid from leaking out from the gap between the first sealing cushion block 20 and the flat pipe 10.

In some embodiments, the first surface is a first arc-shaped convex surface, the second surface is a second arc-shaped convex surface, the first binding surface is a first arc-shaped concave surface, and the second binding surface is a second arc-shaped concave surface. The first arc-shaped concave surface is abutted on the first arc-shaped convex surface, and the second arc-shaped concave surface is abutted on the second arc-shaped convex surface, so that the first sealing cushion block 20 can better seal the gap between two adjacent flat pipes 10, and the sealing effect is thus further improved.

In some embodiments of the present disclosure, the flow collecting shell 30 is provided with a second opening portion 32 and a third opening portion 33, which are arranged opposite to each other, the second opening portion 32 is located on an end of the flow collecting shell 30, the third opening portion 33 is located on the other end of the flow collecting shell 30, the second opening portion 32 is arranged opposite to the third opening portion 33, and the first opening portion 31, the second opening portion 32 and the third opening portion 33 all communicate with each other. The heat exchanger further includes sealing covers 40, and the sealing covers 40 are arranged at both the second opening portion 32 and the third opening portion 33, so as to seal the second opening portion 32 and the third opening portion 33 by the sealing covers 40. By using such settings, the fluid in the flow collecting shell 30 is prevented from flowing out from the second opening portion 32 or the third opening portion 33, and the end portion of the flow collecting channel is sealed by the sealing covers 40.

In some embodiments, the heat exchanger further includes a second sealing cushion block 50, the second sealing cushion block 50 is arranged between the sealing cover 40 and the flat pipe 10, and a third positioning structure is arranged on a side of the second sealing cushion block 50 close to the sealing cover 40, so as to position the sealing cover 40 by the third positioning structure. Specifically, in the present embodiment, the third positioning structure and the sealing cover 40 are positioned in an abutting manner, so as to avoid a location offset of the sealing cover 40 relative to the second sealing cushion block 50, and the setting stability is thus improved.

In some embodiments, the second sealing cushion block 50 includes a second main body block 51 and a second plug-in block 52, the second plug-in block 52 is arranged on the second main body block 51, the second main body block 51 protrudes from the second plug-in block 52, so as to form a positioning step in the encircling manner, and the positioning step forms the third positioning structure, so as to position the sealing cover 40 by the positioning step. In the present embodiment, a step surface of the positioning step is adapted to an end surface of the sealing cover 40, so that the sealing cover 40 is positioned by the step surface of the positioning step in the abutting manner. Therefore, the sealing cover 40 is stably positioned, and then the setting stability is further improved.

In some embodiments, a fourth positioning structure is further arranged on the flat pipe 10, a fifth positioning structure 53 matching the fourth positioning structure is arranged on the second sealing cushion block 50, and the fourth positioning structure is arranged opposite to the fifth positioning structure 53, so as to position the second sealing cushion block 50 by the fourth positioning structure and the fifth positioning structure 53. By using such settings, the second sealing cushion block 50 is conveniently positioned by the cooperation of the fourth positioning structure and the fifth positioning structure 53, thereby avoiding the movement of the second sealing block 50 relative to the flat pipe 10, and improving setting stability of the second sealing cushion block 50.

Specifically, in some embodiments, the fourth positioning structure is a second positioning protrusion, the fifth positioning structure 53 is a second positioning groove, the second positioning protrusion is arranged opposite to the second positioning groove, and the second positioning protrusion is arranged in the second positioning groove, so as to position the second sealing cushion block 50. By using such settings and by the cooperation of the second positioning protrusion and the second positioning groove, a setting location of the second sealing cushion block 50 can be better limited conveniently.

In some embodiments, an end portion of the flat pipe 10 is provided with an arc-shaped port 11, the arc-shaped port 11 is plugged into the first opening portion 31, and the arc-shaped port 11 communicates with a fluid channel in the flat pipe 10, so that the flow collecting channel communicates with the fluid channel in the flat pipe 10. By using such settings, a flow cross-sectional area in the flow collecting shell 30 is increased.

In some embodiments, the flow collecting shell 30, the flat pipe 10 and the first sealing cushion block 20 are welded to form the flow collecting channel in the encircling manner, such that the flow collecting shell 30, the flat pipe 10 and the first sealing cushion block 20 form an integrated structure.

In some embodiments, the heat exchanger further includes heat exchange fins 60, side plates 70 and a connecting pipe 80, the heat exchange fins 60 are arranged on the flat pipe 10, the side plates 70 are located on the end portions of the heat exchanger, and the connecting pipe 80 is used for communicating with the flow collecting channel.

Figure 10:
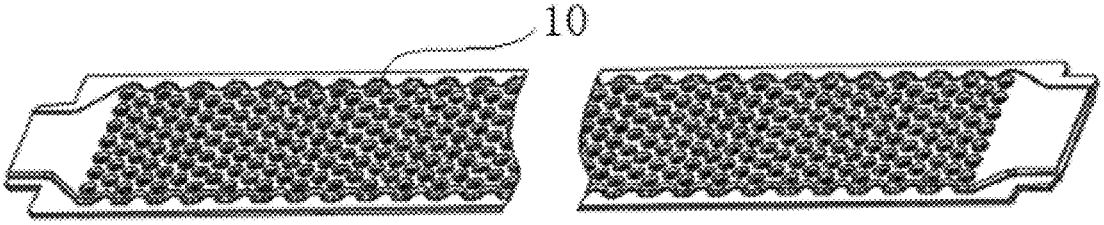
FIG. 10 shows a schematic structural diagram of a flat pipe provided according to Embodiment 2 of the present disclosure.

Embodiment 2 of the present disclosure provides a heat exchanger. The difference between the heat exchanger in Embodiment 2 and the heat exchanger in Embodiment 1 lies in the structure of the flat pipe 10. The structure of the flat pipe 10 of the heat exchanger in Embodiment 2 is shown in FIG. 10.

Figure 11:
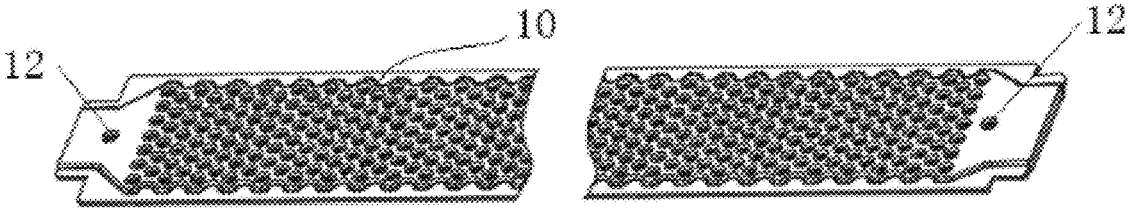
FIG. 11 shows a schematic structural diagram of a heat exchanger provided according to Embodiment 3 of the present disclosure.

Embodiment 3 of the present disclosure provides a heat exchanger. The difference between the heat exchanger in Embodiment 3 and the heat exchanger in Embodiment 1 lies in the structure of the flat pipe 10. The structure of the flat pipe 10 of the heat exchanger in Embodiment 3 is shown in FIG. 11.

Figure 12:
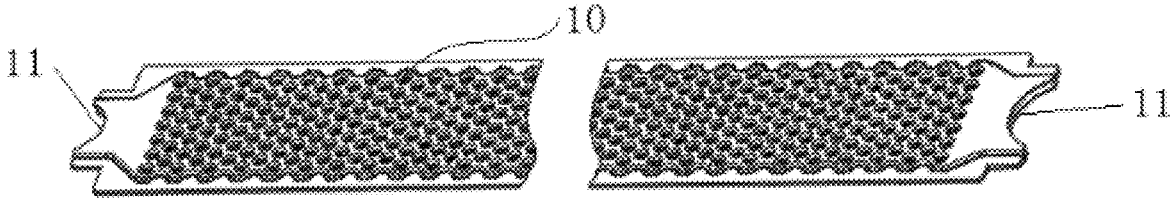
FIG. 12 shows a schematic structural diagram of a heat exchanger provided according to Embodiment 4 of the present disclosure.

Embodiment 4 of the present disclosure provides a heat exchanger. The difference between the heat exchanger in Embodiment 4 and the heat exchanger in Embodiment 1 lies in the structure of the flat pipe 10. The structure of the flat pipe 10 of the heat exchanger in Embodiment 4 is shown in FIG. 12.

From the above descriptions, it can be seen that the above-mentioned embodiments of the present disclosure achieve the following technical effects: the connection strength between the flow collecting shell and the flat pipe is improved, the pressure resistance of the heat exchanger is improved, the flow area in the flow collecting shell is increased, the flow resistance in the flow collecting channel is reduced, and the influence on the performance of a refrigeration system is reduced.

The above descriptions are only some embodiments of the present disclosure, and are not intended to limit the present disclosure. For those skilled in the art, the present disclosure can have various modifications and changes. Any modifications, equivalent replacements, improvements and the like, made within the spirit and principle of the present disclosure, shall be included within the protection scope of the present disclosure.

What is claimed is:

1. A heat exchanger, comprising:

a plurality of flat pipes, wherein the plurality of flat pipes are arranged at intervals;

first sealing cushion blocks, arranged between two adjacent flat pipes, wherein the first sealing cushion blocks are located on end portions of each flat pipe in the two adjacent flat pipes, so as to seal gaps between two adjacent flat pipes by the first sealing cushion blocks; and a flow collecting shell, provided with a first opening portion, wherein at least part of the first sealing cushion blocks and end portions of the flat pipes are all inserted into the first opening portion, so that the flow collecting shell, the flat pipes and the first sealing cushion blocks are welded to form a flow collecting channel in an encircling manner;

wherein the first opening portion is arranged in a communication manner in an extending direction of the first opening portion, and the first sealing cushion blocks and the flat pipes are alternately arranged and stacked in the extending direction of the first opening, a composite layer is disposed on the surface of the flat pipe, after the composite layer is melted, two pipe plates of the flat pipe are kept pressed and fit, when the heat exchanger is welded, the flat pipe is freely declined in the extending direction of the first opening portion under a pre-tightening action;

wherein the flow collecting shell comprises a main body portion and a plug-in portion, wherein the plug-in portion is arranged on the main body portion, the plug-in portion is arranged at an end portion of the main body portion, the plug-in portion is provided with the first opening portion, and at least part of the first sealing cushion block and an end portion of the each flat pipe are plugged into the plug-in portion;

wherein the plug-in portion comprises a first plug board and a second plug board, the first plug board and the second plug board are oppositely arranged on both ends of the main body portion, and the first plug board and the second plug board are arranged at intervals to form the first opening portion, so that at least part of the first sealing cushion block and the end portion of each flat pipe are all plugged between the first plug board and the second plug board;

wherein the first sealing cushion block comprises a first main body block and a first plug-in block, the first plug-in block is arranged on the first main body block, the first main body block is arranged at the end portion of the flat pipe, and the first plug-in block is plugged into the first opening portion;

the first sealing cushion block is a T-shaped block, the first plug-in block is plugged into the first opening portion, the first main body block is located outside the first opening portion.

2. The heat exchanger as claimed in claim 1, wherein the first plug-in block has a first side surface, a second side surface and an arc-shaped concave surface, the first side surface, the arc-shaped concave surface and the second side surface are connected in sequence, the arc-shaped concave surface is located on a side of the first plug-in block away from the first main body block, the first side surface is plugged at the first plug board, and the second side surface is plugged at the second plug board.

3. The heat exchanger as claimed in claim 1, wherein each first sealing cushion block is provided with a first positioning structure, a second positioning structure cooperating with the first positioning structure is arranged on a corresponding flat pipe in the two adjacent flat pipes, and the first positioning structure opposites to the second positioning structure, so as to position the first sealing cushion block by the first positioning structure and the second positioning structure.

4. The heat exchanger as claimed in claim 3, wherein the first positioning structure is a first positioning protrusion, the second positioning structure is a first positioning groove, the first positioning protrusion is arranged opposite to the first positioning groove, and the first positioning protrusion is arranged in the first positioning groove, so as to position the first sealing cushion block.

5. The heat exchanger as claimed in claim 1, wherein each first sealing cushion block has a first binding surface and a second binding surface, which are arranged opposite to each other, an end portion of each flat pipe has a first surface and a second surface, which are arranged opposite to each other, the first binding surface is cooperated with the first surface of the end portion of the each flat pipe, and the second binding surface is cooperated with the second surface of the end portion of the each flat pipe, so that the first binding surface is configured to fit the first surface, and the second binding surface is configured to fit the second surface.

6. The heat exchanger as claimed in claim 1, wherein the flow collecting shell is provided with a second opening portion and a third opening portion opposite to the second opening portion, the second opening portion is located on an end of the flow collecting shell, the third opening portion is located on the other end of the flow collecting shell, and the first opening portion, the second opening portion and the third opening portion all communicate with each other; and the heat exchanger further comprises sealing covers, and the sealing covers are arranged at both the second opening portion and the third opening portion, so as to seal the second opening portion and the third opening portion by the sealing covers.

7. The heat exchanger as claimed in claim 6, wherein the heat exchanger further comprises a second sealing cushion block, wherein the second sealing cushion block is arranged between a sealing cover in the sealing covers and a corresponding flat pipe, and a third positioning structure is arranged on a side of the second sealing cushion block adjacent to the sealing cover, so as to position the sealing cover by the third positioning structure.

8. The heat exchanger as claimed in claim 7, wherein the second sealing cushion block comprises a second main body block and a second plug-in block, wherein the second plug-in block is arranged on the second main body block, the second main body block protrudes from the second plug-in block, so as to form a positioning step in an encircling manner, and the positioning step forms the third positioning structure, so as to position the sealing cover by the positioning step.

9. The heat exchanger as claimed in claim 7, wherein a fourth positioning structure is further arranged on the flat pipe, a fifth positioning structure cooperated with the fourth positioning structure is arranged on the second sealing cushion block, and the fourth positioning structure is arranged opposite to the fifth positioning structure, so as to position the second sealing cushion block by the fourth positioning structure and the fifth positioning structure.

10. The heat exchanger as claimed in claim 9, wherein the fourth positioning structure is a second positioning protrusion, the fifth positioning structure is a second positioning groove, the second positioning protrusion is opposite to the second positioning groove, and the second positioning protrusion is arranged in the second positioning groove, so as to position the second sealing cushion block.

11. The heat exchanger as claimed in claim 1, wherein an end portion of each flat pipe is provided with an arc-shaped port, and the arc-shaped port is plugged into the first opening portion, so that the flow collecting channel communicates with a fluid channel in the flat pipe.

12. The heat exchanger as claimed in claim 1, wherein the flow collecting shell, each flat pipe and each first sealing cushion block are welded to form the flow collecting channel in an encircling manner.

* * * * *